US011045064B2

(12) United States Patent
Smeijer et al.

(10) Patent No.: US 11,045,064 B2
(45) Date of Patent: Jun. 29, 2021

(54) FLAT MOP COVER WITH TWO CLEANING SURFACES

(71) Applicant: CARL FREUDENBERG KG, Weinheim (DE)

(72) Inventors: Dennis Smeijer, PD Haule (NL); Thomas Caruso, Streamwood, IL (US); Leo Gubenko, Winfield, IL (US); Joseph Seifts, Naperville, IL (US)

(73) Assignee: CARL FREUDENBERG KG, Weinheim (DE)

( * ) Notice: Subject to any disclaimer, the term of this patent is extended or adjusted under 35 U.S.C. 154(b) by 1086 days.

(21) Appl. No.: 14/427,338

(22) PCT Filed: May 24, 2013

(86) PCT No.: PCT/EP2013/001536

§ 371 (c)(1),
(2) Date: Mar. 11, 2015

(87) PCT Pub. No.: WO2014/040661

PCT Pub. Date: Mar. 20, 2014

(65) Prior Publication Data

US 2015/0230685 A1 Aug. 20, 2015

(30) Foreign Application Priority Data

Sep. 12, 2012 (DE) ..... 10 2012 017 971.5

(51) Int. Cl.
*A47L 13/257* (2006.01)
*A47L 13/20* (2006.01)

(52) U.S. Cl.
CPC ..... *A47L 13/257* (2013.01); *A47L 13/20* (2013.01)

(58) Field of Classification Search
CPC ..... A47L 13/257; A47L 13/20
(Continued)

(56) References Cited

U.S. PATENT DOCUMENTS 3,862,522 A 1/1975 Mednick
4,159,883 A * 7/1979 Mizell ..... A47K 7/03 15/244.4
(Continued)

FOREIGN PATENT DOCUMENTS

CN 1281501 A 1/2001
CN 1633254 A 6/2005
(Continued)

OTHER PUBLICATIONS

Douglass, Establishing Sound Practices for Cleaning Your Cleanroom, Oct. 12, 2005. pppmag.com, date stamp tittle, passage pertaining to moping cleanroom.*
(Continued)

*Primary Examiner* — Alexander Markoff
(74) *Attorney, Agent, or Firm* — Leydig, Voit & Mayer, Ltd.

(57) ABSTRACT

A flat mop cover for mop-cover holder, where the flat mop cover comprises an elongate basic body. The basic body has a first elongate surface and a second elongate surface, which lie opposite one another. At least one foam-material layer is disposed between the elongate surfaces, and the two elongate surfaces are each configured to be cleaning surfaces. The two elongate surfaces are disposed such that a plate-shaped carrying element of a mop-cover holder is configured to be disposed in a sandwich-like manner between the two surfaces. The basic body is configured to absorb in a reversible manner at least four times, and at most twenty times, its dry weight in liquid, and wherein the foam-material layer has no fibers.

11 Claims, 4 Drawing Sheets

(58) Field of Classification Search
USPC ..... 15/244.3, 105, 118
See application file for complete search history.

(56) References Cited

U.S. PATENT DOCUMENTS

| | | | | | |
|---|---|---|---|---|---|
| 4,403,367 | A * | 9/1983 | Brown | A46B 3/04 | 15/230.12 |
| 4,945,599 | A * | 8/1990 | Flynn | A47L 13/20 | 15/105 |
| 4,985,467 | A | 1/1991 | Kelly et al. | | |
| 4,990,541 | A | 2/1991 | Nielsen et al. | | |
| 5,042,105 | A | 8/1991 | Buck et al. | | |
| 5,177,831 | A * | 1/1993 | Wirth | A47L 13/20 | 15/235 |
| 5,678,278 | A * | 10/1997 | McBride | A47L 13/16 | 15/147.2 |
| 6,148,465 | A * | 11/2000 | Hsieh | A47L 13/12 | 15/118 |
| 6,756,416 | B2 * | 6/2004 | Free | C08G 18/4202 | 521/110 |
| 6,979,371 | B1 * | 12/2005 | Policicchio | C11D 3/30 | 134/39 |
| 2002/0078520 | A1 * | 6/2002 | Salmon | A47L 13/254 | 15/147.2 |
| 2005/0076936 | A1 | 4/2005 | Pung et al. | | |
| 2005/0091775 | A1 | 5/2005 | Lindholm | | |
| 2005/0120497 | A1 | 6/2005 | Lynde et al. | | |
| 2005/0152737 | A1 | 7/2005 | Tien et al. | | |
| 2006/0005338 | A1 * | 1/2006 | Ashe | A47L 13/16 | 15/244.4 |
| 2006/0248673 | A1 * | 11/2006 | Pisacane | A47L 13/254 | 15/228 |
| 2008/0016640 | A1 * | 1/2008 | Reddy | A47L 13/255 | 15/228 |
| 2008/0169052 | A1 * | 7/2008 | Tannijarvi | A47L 13/20 | 150/154 |
| 2008/0209651 | A1 * | 9/2008 | Reponen | A47L 13/42 | 15/143.1 |
| 2009/0165228 | A1 * | 7/2009 | Kilkenny | A01N 37/36 | 15/104.94 |
| 2010/0112273 | A1 * | 5/2010 | Pedoja | D04H 1/4382 | 428/91 |
| 2010/0168638 | A1 | 7/2010 | Korogi et al. | | |

FOREIGN PATENT DOCUMENTS

| | | | | |
|---|---|---|---|---|
| CN | 1652716 | A | 8/2005 | |
| CN | 1863477 | A | 11/2006 | |
| CN | 1886084 | A | 12/2006 | |
| CN | 101489463 | A | 7/2009 | |
| CN | 102333563 | A | 1/2012 | |
| DE | 4312522 | A1 | 10/1994 | |
| DE | 4427672 | C2 | 2/1996 | |
| DE | 10351536 | A1 | 6/2005 | |
| DE | 102005012491 | A1 | 9/2006 | |
| EP | 1704808 | A1 | 9/2006 | |
| GB | 2260543 | A * | 4/1993 | C08J 9/0023 |
| WO | WO 2010002580 | A1 | 1/2010 | |

OTHER PUBLICATIONS

DOW, DOW Plastics Offers Polyolefin Materials, Jul. 4, 1994, Rubber & Plastics News, two paragraphs regarding polyolefin materials.*

EHANS, Cleansing wiht microfiber is easy, effective, less toxic, 2007, EHANS, paragraph on floors.*

* cited by examiner

FLAT MOP COVER WITH TWO CLEANING SURFACES

CROSS-REFERENCE TO RELATED APPLICATIONS

This application is a U.S. National Phase application under 35 U.S.C. § 371 of International Application No. PCT/EP2013/001536, filed on May 24, 2013, and claims benefit to German Patent Application No. DE 10 2012 017 971.5, filed on Sep. 12, 2012. The International Application was published in German on Mar. 20, 2014, as WO 2014/040661 A1 under PCT Article 21 (2).

TECHNICAL FIELD

The invention relates to a flat mop cover.

BACKGROUND

A flat mop cover for arranging on a mop-cover holder, having an elongate basic body, wherein the basic body has a first elongate surface and a second elongate surface, which lie opposite one another, is known from EP 1 704 808 A1.

The two elongate surfaces are each designed as cleaning surfaces. These surfaces can be alternately assigned to a surface which is to be cleaned, for example to a floor.

The two cleaning surfaces are arranged such that a plate-shaped carrying element of a mop-cover holder can be accommodated in a sandwich-like manner between them.

DE 103 51 536 A1 and DE 10 2005 012 491 A1 disclose mop-cover holders which have plate-shaped carrying elements.

The plate-shaped carrying elements can be changed in length in a resiliently reversible manner, for example, and can be introduced into a pocket of a flat mop cover of the type described above and fixed in a force-fitting and form-fitting manner.

The carrying element and flat mop cover may also be fixed only in a force-fitting manner, for example via friction. However, in comparison with the aforementioned force-fitting and form-fitting fixing methods, this is less secure in relation to the flat mop cover being released from the carrying element.

Against this backdrop, the inventors have identified a demand for flat mop covers which can be employed in clean rooms. A clean room, within the context of this document, is understood to be a room in which the size and number of particles located in air are controlled.

On account of their material properties and their manufacture, the inventors have identified that the flat mop covers which are known from the prior art are not particularly suitable for employment in clean rooms.

Against this backdrop, for example DE 44 27 672 C2 shows a flat mop cover made of two layers of a nonwoven material, between which a layer of a particularly absorbent material, such as viscose or foam material of any desired fiber composition, is accommodated.

In specific terms, the layers of nonwoven material are sewn to the absorbent material, wherein the absorbent material is accommodated in topstitched pockets.

Furthermore, longitudinal seams, which extend along the cleaning surfaces, are provided.

In clean rooms, the inventors have determined that it is necessary that the flat mop covers employed do not tend towards particle formation. Furthermore, the inventors have identified that the flat mop covers have to release liquid as uniformly as possible in order to ensure the so-called contact time of the disinfectant, for example in the disinfection of floor or wall surfaces. Contact time is understood to be the period of time which elapses between a film of liquid being applied until it has partially or fully evaporated. It is only during this period of time that the disinfecting solution can take effect.

SUMMARY

In an embodiment, the present invention provides a flat mop cover for mop-cover holder, where the flat mop cover comprises an elongate basic body. The basic body has a first elongate surface and a second elongate surface, which lie opposite one another. At least one foam-material layer is disposed between the elongate surfaces, and the two elongate surfaces are each configured to be cleaning surfaces. The two elongate surfaces are disposed such that a plate-shaped carrying element of a mop-cover holder is configured to be disposed in a sandwich-like manner between the two surfaces. The basic body is configured to absorb in a reversible manner at least four times, and at most twenty times, its dry weight in liquid, and wherein the foam-material layer has no fibers.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DESCRIPTION OF THE INVENTION

Figure 1:
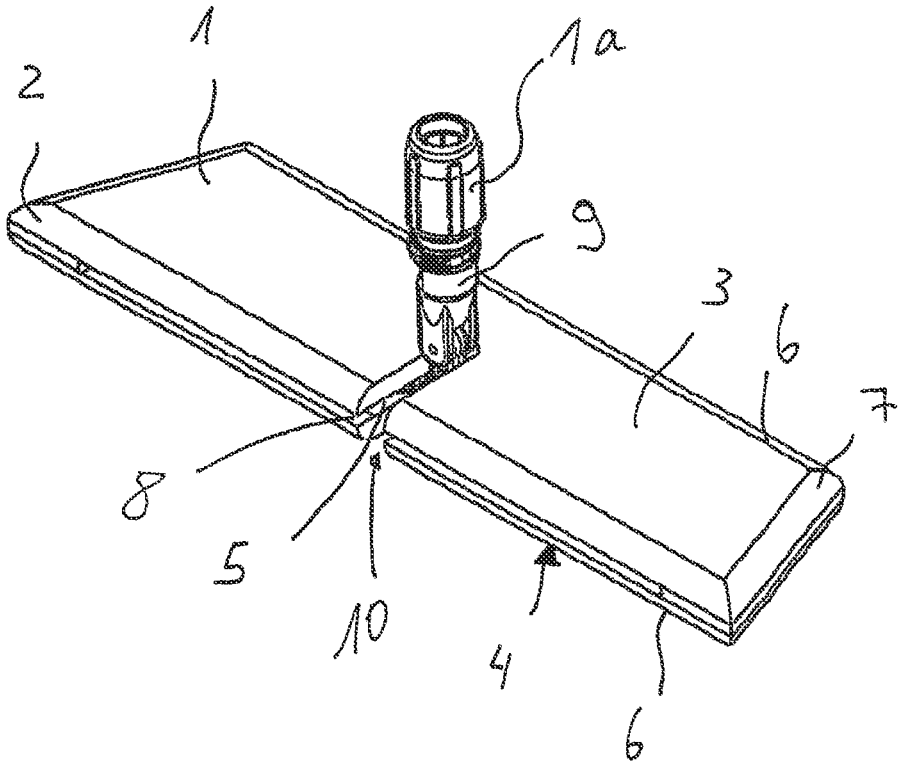
FIG. 1 shows a perspective view of a mop-cover holder having a flat mop cover.

An aspect of the invention is to configure and refine a flat mop cover such that surfaces which are to be cleaned in a clean room can readily be cleaned by it.

According to an aspect of the invention, it has been recognized, in the first instance, that the basic body has to serve as a liquid store, in order to store a relatively large quantity of liquid. It has then been recognized that the basic body has to discharge the stored liquid as uniformly as possible, and in a metered manner, onto a surface which is to be cleaned.

Specifically, it has been recognized that the basic body has to be able to store a large amount of liquid, in particular a liquid provided with a disinfectant, and discharge this uniformly and continuously, over a relatively long mopping operation, onto a surface which is to be cleaned.

In the case of a cleaning operation, the flat mop cover can be employed in two ways. On the one hand, it may be present in dry form and be provided with a certain quantity of cleaning liquid, for example in a metering tray, on site and just prior to the cleaning operation. Following cleaning, the flat mop cover is dropped in a separate container, in order then either to be cleaned, in particular washed, or disposed of.

On the other hand, it is possible to pre-soak a plurality of flat mop covers in a box by these having a defined quantity of cleaning liquid poured over them, for example at the same time. Thereafter, the pre-moistened flat mop covers are transported, on a trolley, to the cleaning site and drawn onto the mop-cover holder there in each case for cleaning purposes. Once cleaning has taken place, the flat mop covers are dealt with as mentioned above. They may be washed or disposed of.

Furthermore, according to an aspect of the invention, use is made of a foam material which has no fibers. This effectively avoids contaminating a clean-room atmosphere.

A basic body which can store four to twenty times its dry weight in liquid, in addition, realizes a flat mop cover which can be readily used to clean surfaces which are to be cleaned in a clean room.

The foam-material layer could be continuous over its surface area. For cost-related reasons, it is advantageous not to interrupt the foam-material layer. Furthermore, it is conceivable for drainage holes to be provided in the region of a lower, closed surface of the flat mop cover. Against this backdrop, the foam-material layer is configured to be continuous over at least 90% of its height on the two cleaning sides of the flat mop cover. The remaining 10% of the height can be used for drainage holes.

A foam-material layer has proven to be particularly absorbent. Moreover, a foam-material layer which has no fibers does not tend to shed particles or fibers. Foam materials are cost-effective to produce in more or less any form and are distinguished by a high liquid-absorption capacity. Moreover, foam materials are soft, elastic and readily adjustable in respect of their liquid-absorption and -discharging capacity. This can be achieved by suitable adjustment of the porosity. In specific terms, use could be made of an open-pore foam material which does not comprise fibers or display such.

The basic body could have at least one inner foam-material layer, the outer side of which is connected to at least one enveloping layer by stitch bonding. This specific configuration allows the enveloping layer to assume abrasive properties, wherein a liquid store is created in the inner foam-material layer.

The basic body could have at least one inner foam-material layer, wherein a further textile outer layer is applied to the outer sides, which can be turned towards the surface which is to be cleaned.

It is conceivable here for the foam-material core not to have a separate outer layer and for only the foam-material core to come into contact directly with the floor. A suitable selection of the materials, for example plastomeric microfibers, allows this outer layer to have special properties for cleaning or abrasive removal of dirt.

An enveloping layer, within the context of this document, is therefore not necessarily a textile structure which exists separately without the basic body. Stitch bonding gives rise not to a separate textile structure, but just to a textile surface, that is to say to an enveloping layer connected to the foam-material layer.

A textile outer layer may consist, in particular, of microfiber threads or yarns, wherein use is preferably made of so-called filament yarns made of endless filaments, in order to prevent the release of particles when fibers break.

In the case of so-called staple fiber yarns, it is possible for mechanical loading, for example during cleaning, to result in fiber breakage. The shorter length of the staple fibers means that the latter are retained less well in the yarn than is the case with endless filaments.

It is usually the case that two sheet-like textiles are connected to one another by sewing. In the case of stitch bonding, however, just a single thread is sewn to a substrate, to be precise, as in the case of mechanical knitting, stitches being made in a single row, parallel, and at the same time. A non-closed surface is thus formed. The outer cleaning surface is not connected to the foam material core by virtue of a sheet-like cleaning textile being sewn on.

To this extent, the outer cleaning surfaces could not be connected to the foam-material layer by sewing. It is specifically conceivable here for the surfaces to be connected to the foam-material layer by stitch bonding. Sewing on a genuinely separate enveloping layer or a cleaning material involves increased effort and costs. Furthermore, the enveloping layer or the cleaning material is more likely to slip in relation to the foam-material layer. Slippage can indeed be prevented by use being made of a plurality of fixing seams running, for example, in the longitudinal direction. There is also the risk of a usually very thin cleaning material being damaged. This damage may result from elevations and unevennesses in the floor.

The basic body could have at least one inner foam-material layer, at least one enveloping layer being laminated over the entire surface, or most of the surface, of the outer side thereof. A laminating process can be carried out cost-effectively.

Lamination takes place usually over the entire surface area, but may also take place, in a grid or strip formation, over only part of the surface. It is also conceivable for the enveloping layer to be applied by adhesive bonding, e.g. by so-called hot-melt adhesives. It is thus possible for two nonwoven-material layers to be connected without the water supply being adversely affected as a result. A so-called hot-melt adhesive is applied, for example, in thin helical lines.

In particular it is conceivable to carry out flame lamination. Lamination produces chemical bonding between a foam material and an enveloping layer, or a foam material and a foam material, without any further adhesives.

Lamination with the aid of an adhesive or adhesive bonding would produce a barrier between the outer enveloping layer and the foam material. This would prevent liquid from flowing inwards or outwards. To this extent, this barrier would produce a kind of shut-off valve which prevents liquid flow.

Flame lamination technology uses an extremely large quantity of heat in order to produce a chemical change or to bring about bonding of materials, in order that these undergo bonding.

This gives rise to an integral material unit which allows a liquid to flow easily from the inside to the outside and vice versa.

Against this backdrop, it is conceivable for the basic body to be sealed. The sealing can produce peripheral regions and corners on the basic body which release particles only to a slight extent.

The basic body could have at least one inner foam-material layer, at least one enveloping layer being drawn onto the outer side thereof. Such an enveloping layer may be provided with a piece of elastic and be drawn in a sock-like manner over the core of the basic body.

The foam-material layer could have a thickness of 5 to 15 mm. Such a thickness has proven advantageous for both absorbing and discharging liquid in a defined manner.

Each elongate surface could have in each case one foam-material layer, or a part of the foam-material layer, directed towards it or assigned to it. This ensures that in each case one foam-material layer of 5 to 15 mm in thickness can be turned towards a surface which is to be cleaned.

The basic body, fastened on the mop-cover holder, can be turned, and therefore first one elongate surface, and then the other elongate surface, is directed towards a floor.

In any case, a foam-material layer with a thickness of 5 to 15 mm is directed towards the floor, wherein the enveloping layer is arranged between the foam-material layer and the floor.

The two elongate surfaces could accommodate between them a pocket for accommodating a carrying element. This specific configuration makes it possible for a changeable-length mop plate, as is known, for example, from DE 10 2005 012 491 A1, to be readily introduced into the flat mop cover.

A mop-cover holder could comprise a flat mop cover of the type described here. Such a mop-cover holder comprises a mop plate, on which a preferably cardanically articulated shaft or a handle is fastened. Such a mop-cover holder can be used to clean a surface, in particular a floor.

The cardanic attachment of the mop plate to a shaft or to a handle allows the basic body to be pivoted together with the mop plate. During a pivoting operation, a changeover takes place such that one elongate surface is pivoted away from the floor, whereas the other elongate surface ends up located thereon.

Such a mop-cover holder is used preferably in a clean room. A clean room, within the context of this document, is understood as being a room in which the size and number of particles located in air are controlled.

Its high absorption capacity means that the basic body can absorb a very large quantity of liquid and discharge the same in a defined, uniform and metered manner onto a surface which is to be cleaned.

The entire flat mop cover can be used as a disposable product, which is suitable for being used just once, or as a semi-disposable product, which is suitable for being employed only a few times. The entire flat mop cover here can be produced, washed, sterilized and packaged in a sterile state, in order to meet the stringent clean-room requirements relating to sterility and the lowest possible release of particles. Prior to employment, the entire flat mop cover is soaked in a liquid.

The basic body preferably has a core made of at least one foam-material layer with a textile cleaning surface on the outer sides thereof. Specifically, it is conceivable for the outer side to be covered by an enveloping layer made of nonwoven material.

The enveloping layer can be connected to the core by lamination, stitch bonding or by force-fitting abutment.

FIG. 1 shows a flat mop cover 1 for arranging on a mop-cover holder 1*a*, comprising an elongate basic body 2, wherein the basic body 2 has a first elongate surface 3 and a second elongate surface 4, which lie opposite one another, wherein at least one foam-material layer 6 is arranged between the elongate surfaces 3, 4, and wherein the two elongate surfaces 3, 4 are each designed as cleaning surfaces and arranged such that a plate-shaped carrying element 5 of a mop-cover holder 1*a* can be accommodated in a sandwich-like manner between them.

The basic body 2 can absorb in a reversible manner at least four times, and at most twenty times, its dry weight in liquid, wherein the foam-material layer 6 has no fibers.

The basic body 2 has at least one foam-material layer 6. The foam-material layer 6 is continuous over its surface area.

The basic body 2 has only one inner foam-material layer 6, the outer side of which is provided with at least one enveloping layer 7. The enveloping layer 7 can be stitch bonded, laminated onto the foam-material layer 6 or drawn onto the foam-material layer 6.

The foam-material layer 6 has a thickness of 5 to 15 mm. Each elongate surface 3, 4 has in each case one region of the folded-over foam-material layer 6 directed towards it or assigned to it.

The two elongate surfaces 3, 4 accommodate between them a pocket 8 for accommodating a carrying element 5.

FIG. 1 shows a mop-cover holder 2, wherein the mop-cover holder 1*a* has, as carrying element 5, a mop plate, on which a shaft (not shown) is arranged with cardanic mounting via an articulation 9.

Figure 2:
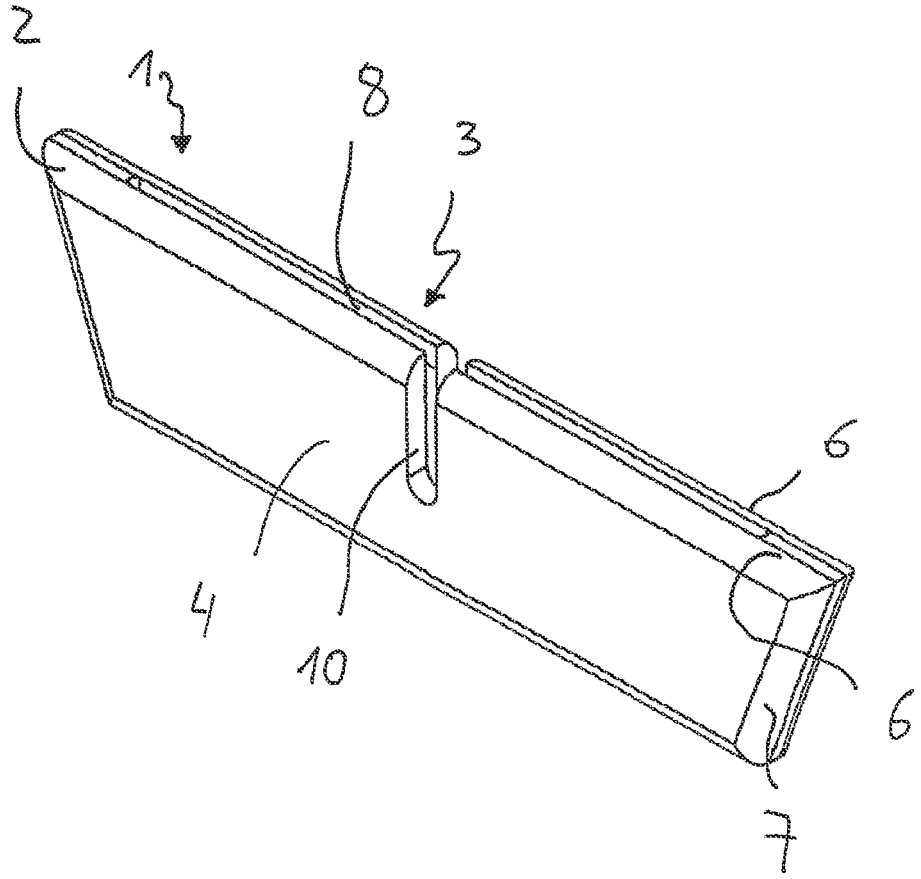
FIG. 2 shows an illustration solely of the flat mop cover according to FIG. 1.
Figure 3:
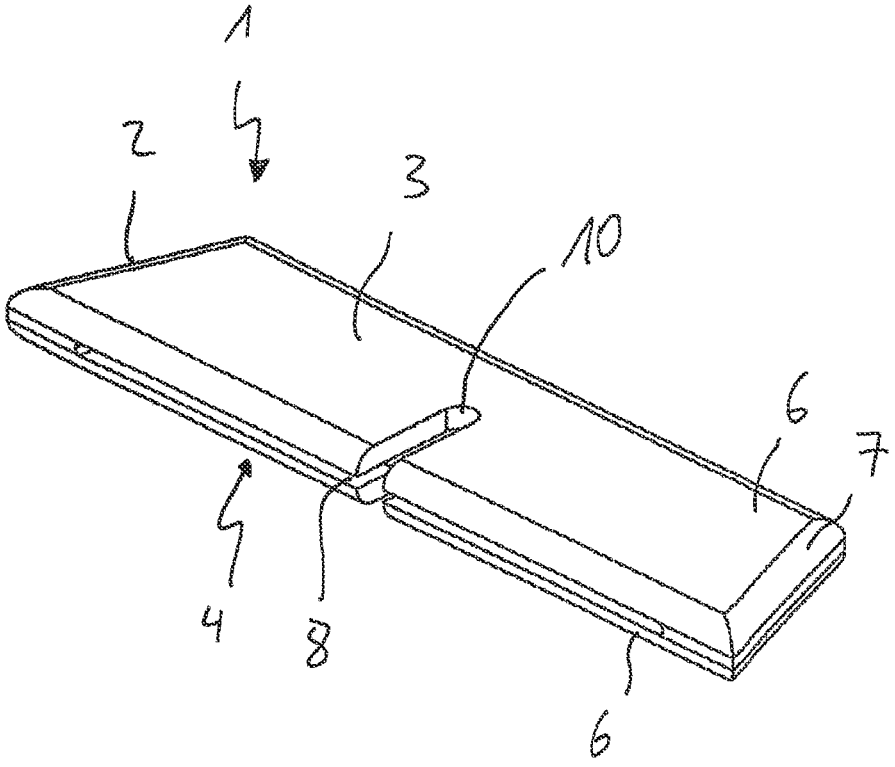
FIG. 3 shows a further perspective view of the flat mop cover according to FIG. 1.

FIGS. 2 and 3 show that the single, continuous foam-material layer 6 is folded over such that it extends over the two elongate surfaces 3, 4.

The foam-material layer 6 contains an aperture 10, into which the articulation 9 can be pushed together with the carrying element 5.

On account of the elongate, slot-like aperture 10, the basic body 2 can be pivoted about the articulation 9 such that either the elongate surface 3 or the elongate surface 4 can be assigned alternately to a floor (not shown) or to a surface which is to be cleaned.

The specific exemplary embodiment shows a so-called double-sided flat mop cover 1 with a core made of a foam-material layer 6, wherein the foam-material layer 6, rather than having a cleaning side, serves merely as a water store.

The actual cleaning surfaces are the surfaces 3, 4, which are formed by the enveloping layer 7.

A thin enveloping layer 7 made of a cleaning textile, preferably made of nonwoven material or of microfibers, is applied by lamination, or by stitch bonding, to an outer side of the foam material core which is directed towards the floor.

Either a thin polyester (PES) nonwoven-material layer is applied to the foam-material layer 6 by flame lamination or a layer of microfibers which produces two and a half dimensions is stitch bonded thereto. The stitch bonding does not result in a smooth, closed surface as is the case, for example, with a woven textile; rather, it may also form small loops, which project from the substrate. This can be done very cost-effectively.

In contrast to the prior art of DE 44 27 672 C2, the foam-material layer 6 is designed to be continuous and is not accommodated in longitudinal pockets, as shown in FIG. 1 or 2 of DE 44 27 672 C2.

There is no enveloping layer 7 or textile sheet-like structure provided on the inner side of the foam-material layer 6, this inner side being directed towards the carrying element 5; rather, the carrying element 5 is in direct contact with the foam-material layer 6.

The two elongate surfaces 3, 4 of the flat mop cover 1 are not, at the two short end sides thereof, connected by a seam as in DE 44 27 672 C2; rather, the foam material is welded or adhesively bonded or connected integrally in some other way. Welding can be done using ultrasound. This is cost-effective and ensures relatively low release of particles for clean-room applications.

The upwardly oriented peripheries of the two elongate surfaces 3, 4, rather than being specially sewn or sealed, are open. The laminated-on or stitch-bonded enveloping layer 7 still extends around these peripheries, to the inner sides of the pocket 8, in order also to allow a skirting board to be cleaned at these locations.

Figure 4:
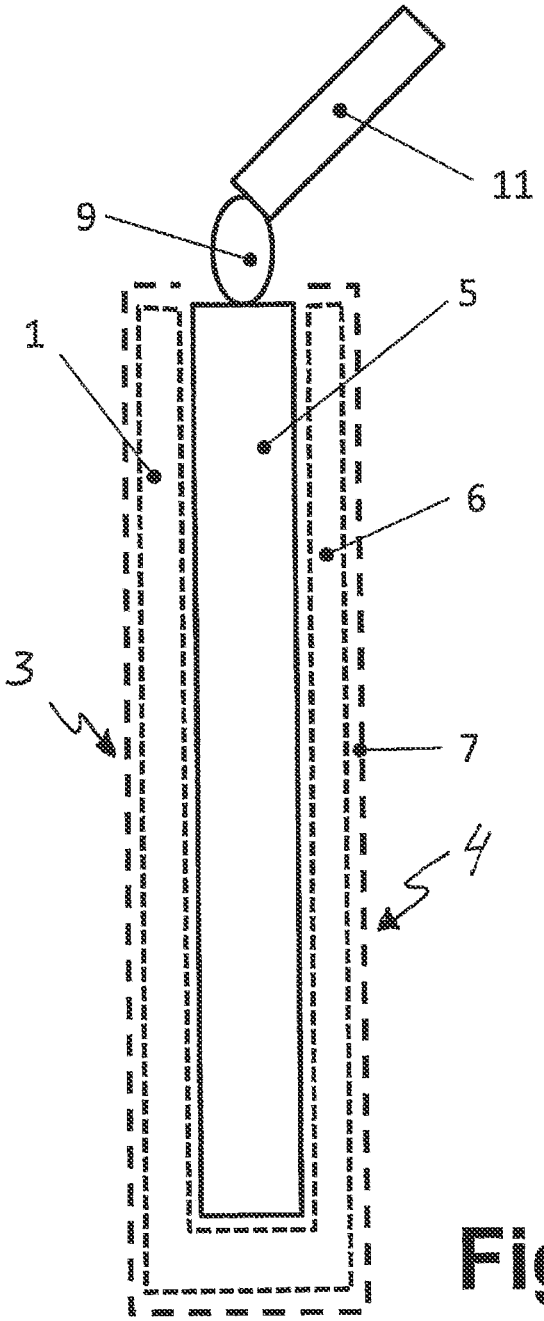
FIG. 4 shows a sectional view of the flat mop cover and the mop-cover holder.

FIG. 4 shows a sectional view of the flat mop cover 1, wherein a carrying element 5 is accommodated in a sandwich-like manner within a core made of a single continuous foam-material layer 6. A shaft 11 is attached to the carrying element 5 via a cardanic articulation 9. The foam-material layer 6 has an enveloping layer 7 on its outer sides.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A flat-mop cover for a flat-mop-cover holder, the flat-mop cover comprising:

an elongate basic body having an enveloping layer including a first elongate surface and a second elongate surface lying opposite one another, wherein at least one foam-material layer is disposed between the elongate surfaces, and wherein the two elongate surfaces are each configured to be cleaning surfaces and disposed such that a plate-shaped carrying element of the flat-mop-cover holder is configured to be sandwiched between the two surfaces, wherein the basic body is configured to absorb at least four times, and at most twenty times, its dry weight in cleaning liquid and to discharge the cleaning liquid in a uniform and metered manner onto a surface to be cleaned, and wherein the foam-material layer has no fibers, and wherein the foam-material layer is continuous over the surface area of the foam-material layer.

2. The flat-mop cover according to claim 1, wherein the basic body has at least one inner foam-material layer, wherein an outer side of the at least one inner foam-material layer is connected to at least one enveloping layer by stitch bonding.

3. The flat-mop cover according to claim 1, wherein the basic body has at least one inner foam-material layer, wherein at least one enveloping layer is laminated on the outer side of the at least one inner foam-material layer.

4. The flat-mop cover according to claim 1, wherein the basic body has at least one inner foam-material layer, wherein at least one enveloping layer is drawn onto the outer side of the at least one inner foam-material layer.

5. The flat-mop cover according to claim 1, wherein the foam-material layer has a thickness in a range from 5 mm to 15 mm.

6. The flat-mop cover according to claim 1, wherein the two elongate surfaces accommodate between them a pocket for accommodating a carrying element.

7. A flat-mop-cover holder having a flat-mop cover, the flat-mop cover comprising:

an elongate basic body having an enveloping layer including a first elongate surface and a second elongate surface lying opposite one another, wherein at least one foam-material layer is disposed between the elongate surfaces, and wherein the two elongate surfaces are each configured to be cleaning surfaces and disposed such that a plate-shaped carrying element of the flat-mop-cover holder is configured to be sandwiched between the two surfaces, wherein the basic body is configured to absorb in a reversible manner at least four times, and at most twenty times, its dry weight in cleaning liquid and to discharge the cleaning liquid in a uniform and metered manner onto a surface to be cleaned, and wherein the foam-material layer has no fibers, and wherein the foam-material layer has a continuous surface area.

8. A method of cleaning a clean room, the method comprising:

providing a flat-mop cover comprising:

an elongate basic body having an enveloping layer including a first elongate surface and a second elongate surface lying opposite one another, wherein at least one foam-material layer is disposed between the elongate surfaces, and wherein the two elongate surfaces are each configured to be cleaning surfaces and disposed such that a plate-shaped carrying element of a flat-mop-cover holder is configured to be sandwiched between the two surfaces, wherein the basic body is configured to absorb in a reversible manner at least four times, and at most twenty times, its dry weight in cleaning liquid and to discharge the cleaning liquid in a uniform and metered manner onto a surface to be cleaned, and wherein the foam-material layer has no fibers, and wherein the foam-material layer has a continuous surface area; and wiping a floor of the clean room with the mop cover.

9. The flat-mop cover of claim 1, wherein the enveloping layer comprises a textile.

10. The flat-mop cover of claim 1, wherein the enveloping layer comprises plastomeric microfibers.

11. The cover of claim 1, wherein the enveloping layer comprises filament yarn comprising endless filaments.

* * * * *